US005677595A

United States Patent [19]

Sakai et al.

[11] Patent Number: 5,677,595

[45] Date of Patent: Oct. 14, 1997

[54] RESISTOR ASSEMBLY AND ELECTRON MULTIPLIER USING THE SAME

[75] Inventors: Shirou Sakai; Makoto Nakamura; Hiroshi Suzuki; Kazunori Wada; Hiroyuki Kyushima; Tetsuya Morita, all of Hamamatsu, Japan

[73] Assignee: Hamamatsu Photonics K.K., Shizuoka-ken, Japan

[21] Appl. No.: 561,834

[22] Filed: Nov. 27, 1995

[30] Foreign Application Priority Data

Nov. 30, 1994 [JP] Japan ..... 6-297257

[51] Int. Cl.[6] ..... H01J 43/04

[52] U.S. Cl. ..... 313/532; 313/533; 313/528; 313/103 CM; 313/105 CM; 313/105 R; 313/103 R

[58] Field of Search ..... 313/103 CM, 105 R, 313/103 R, 105 CM, 533, 528, 541, 532, 534–537, 540, 542; 338/20, 198, 260, 307, 308, 309, 314; 250/214 VT

[56] References Cited

U.S. PATENT DOCUMENTS

| | | | |
|---|---|---|---|
| 3,579,017 | 5/1971 | Vestal | 313/105 R |
| 3,691,503 | 9/1972 | Battle et al. | 338/20 X |
| 3,745,508 | 7/1973 | Bruder et al. | 338/309 X |
| 4,409,474 | 10/1983 | Howarth | 313/105 R X |
| 4,503,418 | 3/1985 | Belopolsky et al. | 338/309 |
| 4,899,126 | 2/1990 | Yamada | 338/307 X |
| 5,119,272 | 6/1992 | Ohyama et al. | 338/307 X |
| 5,498,929 | 3/1996 | Kyushima et al. | 313/103 CM |
| 5,543,775 | 8/1996 | Huck | 338/314 X |

*Primary Examiner*—Ashok Patel

*Attorney, Agent, or Firm*—Sughrue, Mion, Zinn, Macpeak & Seas, PLLC

[57] ABSTRACT

An electron multiplier includes an improved resistor assembly for applying relevant voltages to respective dynodes. Resistor patterns are printed on one surface of an insulation substrate. Each resistor pattern is connected to one end of one of a plurality of conductor patterns which are also printed on the same surface of the insulation substrate, so that each resistor pattern is sandwiched between adjacent conductor patterns to provide a predetermined resistance therebetween. The other end of each conductor pattern extends to a corresponding insertion hole formed on the insulation substrate. One end of a conductor element, which may be a lead, wire, or other wire shaped conductor, is inserted into the corresponding insertion hole and electrically connected to its corresponding conductor pattern. At least the area around where the conductor pattern is connected to the conductor element and also areas around resistor patterns are covered with an insulating seal material. The other end of each conductor element is left exposed without being covered with the seal material and connected to a corresponding dynode.

12 Claims, 14 Drawing Sheets

RESISTOR ASSEMBLY AND ELECTRON MULTIPLIER USING THE SAME

BACKGROUND OF THE INVENTION

1. Field of the Invention

The present invention relates to a resistor used in an electron multiplier and to an electron multiplier provided with such a resistor.

2. Description of the Related Art

There have been known electron multipliers for detecting radiant energy which may be radiations of electron rays, ion rays, charged particle rays, vacuum ultraviolet rays, and soft X-rays.

FIGS. 1(A) and 1(B) show an example of a conventional electron multiplier, Wherein FIG. 1(A) is a fragmentary diagram and FIG. 1(B) is a side view of the assembled electron multiplier. The electron multiplier includes a multi-stage dynodes DY and a collection electrode or anode. A number of secondary electrons are emitted at the first stage dynode upon impingement of the energy beams. These secondary electrons in turn are directed to a second stage dynode and so on. The electrons from the last dynode are collected by the collection electrode which provides the signal current that is read out. In use, the electron multiplier is placed in a vacuum environment when radiant energy is to be detected.

The electron multiplier shown in FIGS. 1(A) and 1(B) includes box-structure dynodes DY, each being supported on its own support frame 100. One resistor R is mounted on each support frame 100. That is, the resistors R equal in number to the dynodes DY are provided. Each resistor R has two leads L extending from each of its two ends. One lead of each resistor R is cut, bent, and welded to the support frame 100 on which the resistor R is mounted, and the other lead is cut, bent, and welded to the adjacent support frame 100. The resistors R provided in the respective stages of the dynode stack are connected in series across a voltage source so that a predetermined voltage is applied to each of the dynodes DY.

FIG. 2 shows another conventional electron multiplier having 3-stage box-structure dynodes and 13-stage in-line structure dynodes. The electron multiplier has a pair of ceramic plates (ceramic insulator) 101 disposed in spaced apart relation, for supporting both sides of the dynodes DY. A plurality of slits 102 are formed at a fixed interval in each of the two side edges of the ceramic plates 101. The leads L of each resistor R are inserted into corresponding slits 102 in the pair of ceramic plates 101. The inserted leads L are bent and welded to the tip of a protruding slat DYc of each dynode DY. This connects each resistor R to its corresponding dynode and also supports and fixes the dynodes DY and resistors R in place.

However, several problems exist in conventional electron multipliers. For example, attempts to miniaturize conventional multipliers have been frustrated by the resistors R which are aligned with corresponding dynodes DY of the multi-stage dynodes. Also, electrically welding the resistors R to corresponding dynodes DY is a time consuming and troublesome operation.

It is required that the electron multiplier be usable under super high vacuum and that the voltage division resistors release substantially no gas under such super high vacuum measuring environment. It is further required that the resistors be able to withstand high temperature baking process, say baking at a temperature of 400° C., yet represent stable characteristic. Because solder will melt during baking at 400° C., resistors R and dynodes DY cannot be connected using solder.

The above-described resistor arrangement is not applicable to electron multipliers that have a multi-stage blade-shaped dynodes stacked in closely spaced relation.

SUMMARY OF THE INVENTION

It is an object of the present invention to overcome the above-described problems and to provide an electron multiplier wherein voltage division resistors for applying relevant voltages to dynodes are easy to attach and take up little space.

To attain the above and other objects, the resistor assembly according to the present invention includes resistor patterns formed on one surface of a plate-shaped insulation substrate. Each resistor pattern is connected to one end of one of a plurality of conductor patterns formed also on the same surface of the insulation substrate, so that each resistor pattern is sandwiched between adjacent conductor patterns to develop a predetermined resistance therebetween. The other end of each conductor pattern extends to a corresponding insertion hole formed in the insulation substrate. One end of a conductor element is inserted into a corresponding insertion hole and electrically connected to its corresponding conductor pattern. At least the area around where the conductor pattern is connected to the conductor element and also areas around resistor patterns are covered with an insulating seal material. The other end of each conductor is left exposed without being covered with the seal material and connected to a corresponding dynode.

The conductor element can be a lead, wire, or other wire shaped conductor. The conductor member can also be a plate or ribbon shaped conductor.

The electron multiplier includes the above-described resistor assembly, a plurality of dynodes, a collection electrode (anode), and a substrate for supporting the dynodes. The resistor assembly divides a predetermined d.c. voltage and applying divided voltages to the respective dynodes.

The seal material can be formed from a first seal material for covering the conductor patterns and the plurality of resistor patterns while leaving uncovered the area around where conductor members connect with corresponding conductor patterns, and a second seal material for covering the area around where conductor members connect with corresponding conductor patterns.

These resistor patterns, conductor patterns, and seal materials can also be provided to the opposite surface of the insulation substrate. In this case, the holes are formed as through-holes that penetrate from one side to the other side of the insulation substrate. Also, corresponding conductor patterns formed to either side of the insulation substrate are connected to each other.

Two mesh electrodes can also be disposed in the above-described electron multiplier aligned in a direction in which incident energy rays are incident.

The electron multiplier can further be provided with a plurality of conductor connection pins extending in the direction in which the dynodes are stacked. One end of each connection pin is connected to a corresponding dynode and the other end of each connection pin is passed through a corresponding through-hole so that it protrudes from the underside surface of the substrate. The above-described resistor assembly is disposed on the underside surface of the substrate. Each conductor member extending from the resistor assembly is connected with the other end of a corresponding connection pin.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

A resistor assembly and an electron multiplier according to preferred embodiments of the present invention will be described while referring to the accompanying drawings.

Figure 1:
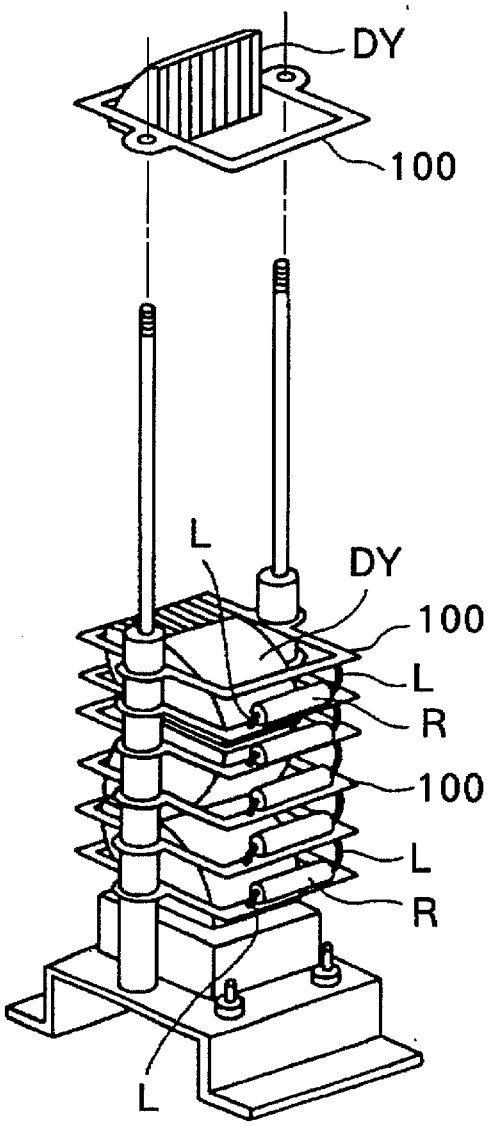
FIG. 1 (A) PRIOR ART
FIG. 1(A) is a perspective fragmentary view schematically showing configuration of a conventional electron multiplier.
FIG. 1(B) is a side view schematically showing configuration of the conventional electron multiplier of FIG. 1(A)
Figure 1:
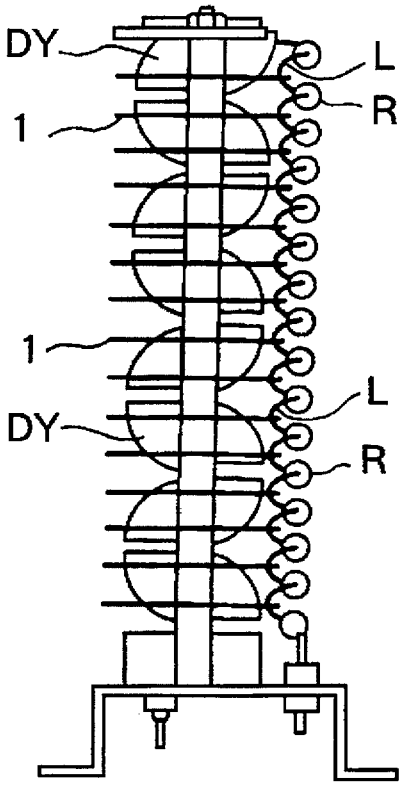
FIG. 1 (B) PRIOR ART
Figure 2:
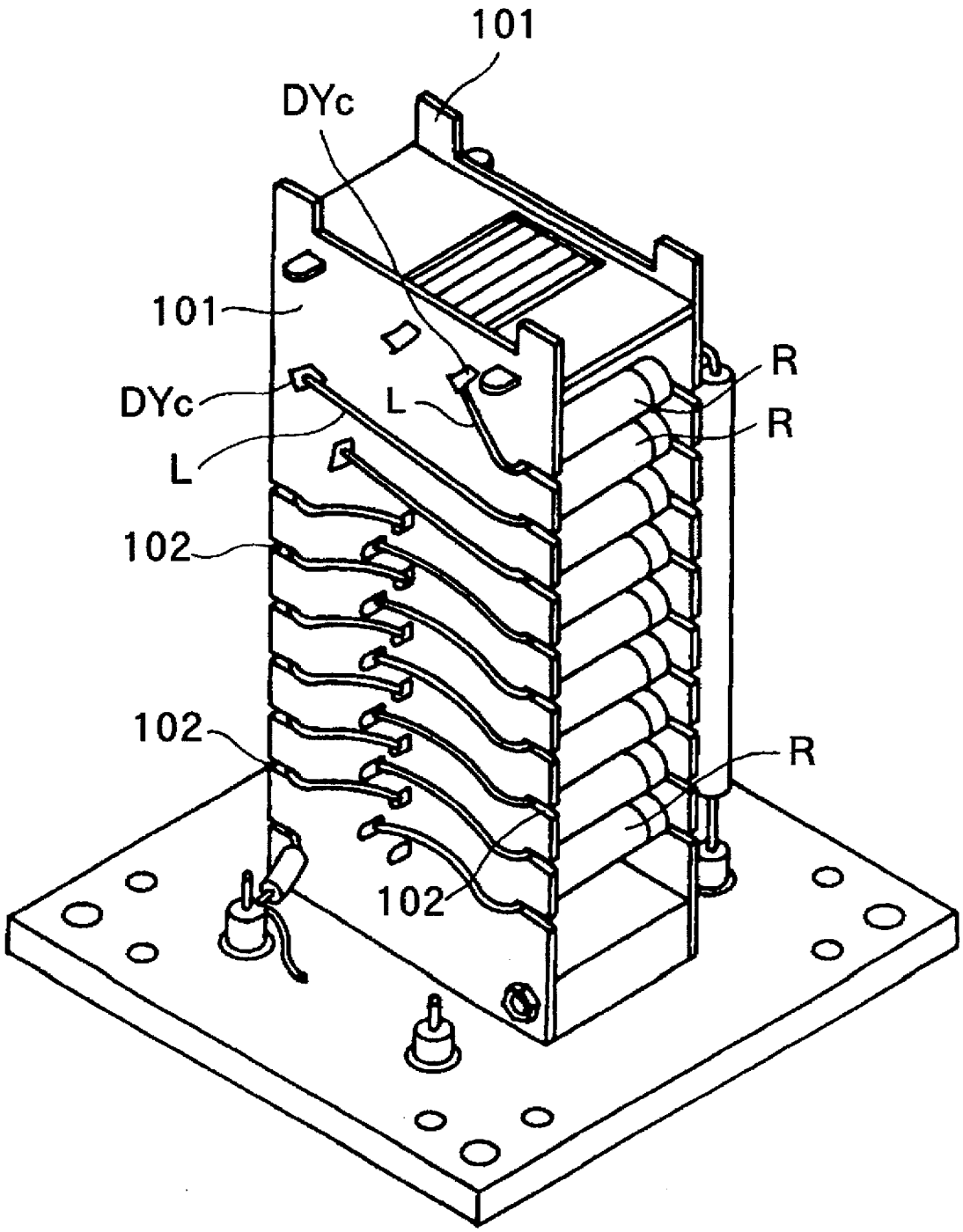
FIG. 2 PRIOR ART
FIG. 2 is a perspective view schematically showing configuration of another conventional electron multiplier.
Figure 3:
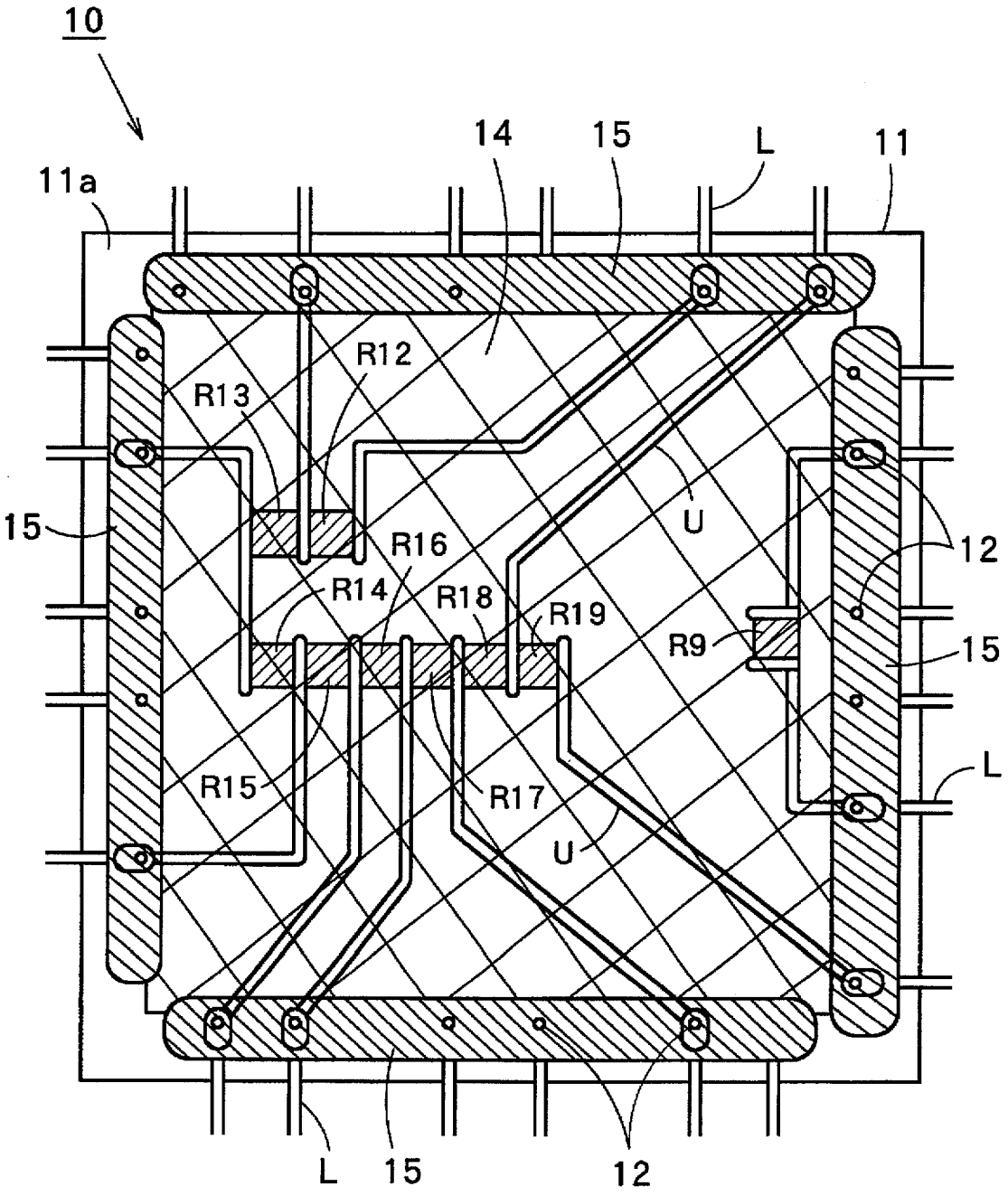
FIG. 3 is a planar view showing a top surface of a resistor according to a first embodiment of the present invention.
Figure 4:
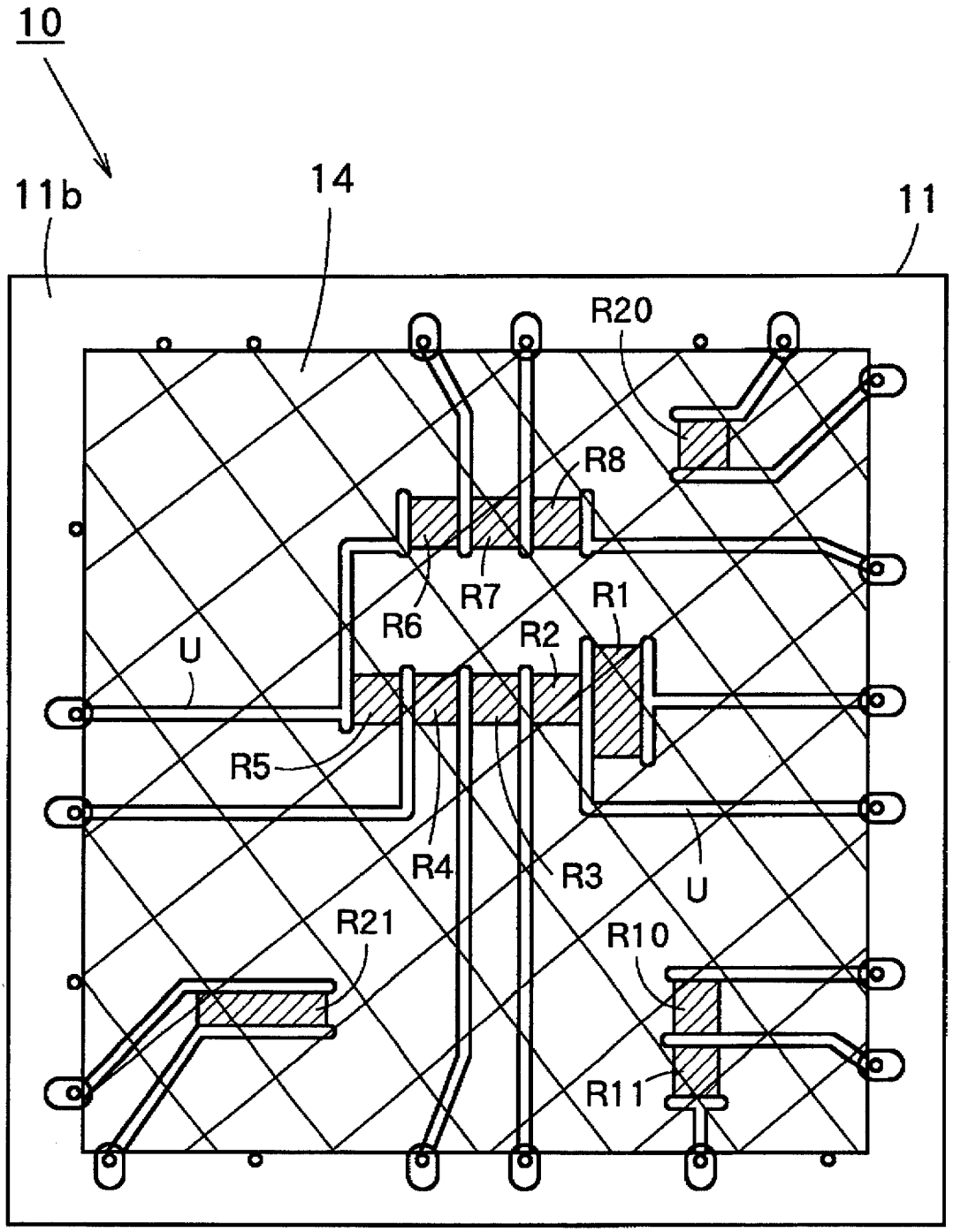
FIG. 4 is a planar view showing an underside surface of the resistor shown in FIG. 3.
Figure 5:
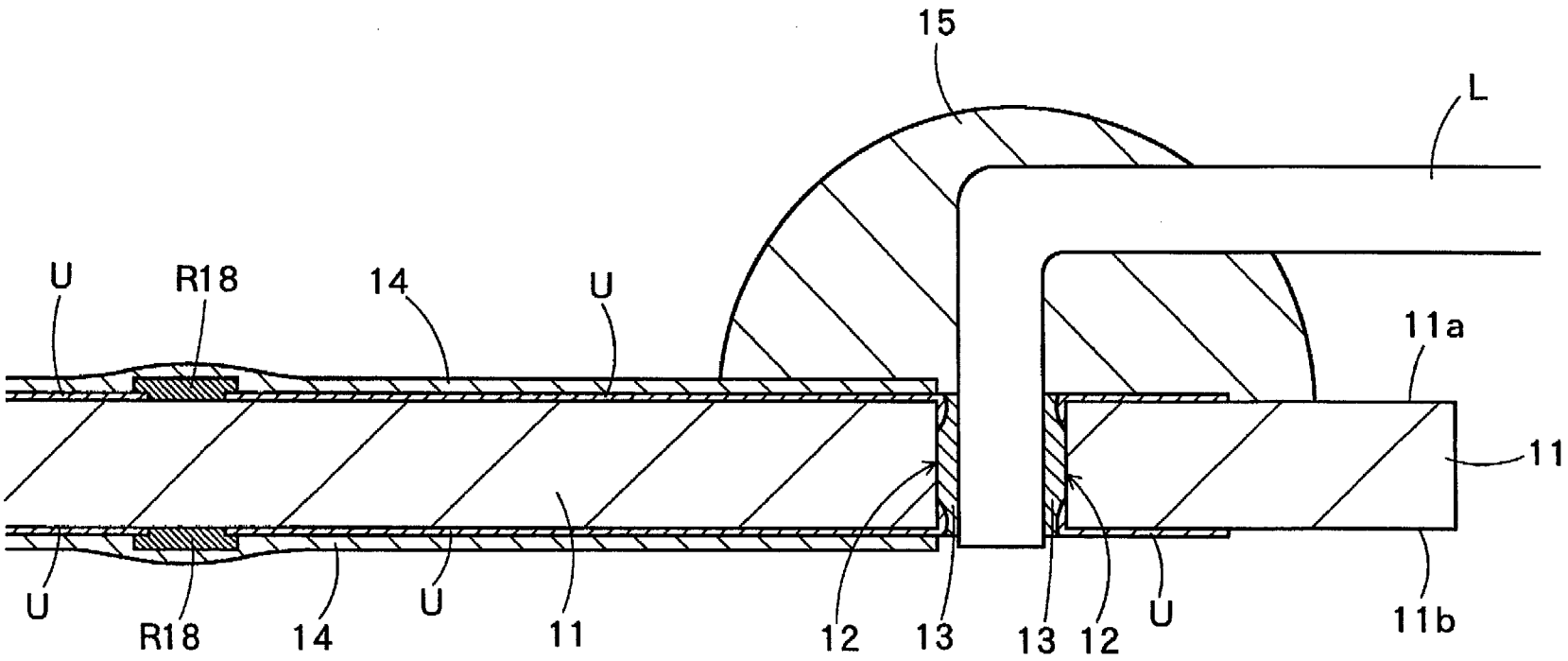
FIG. 5 is a cross-sectional view of the resistor of FIGS. 3 and 4 showing details of the periphery around insertion holes of the resistor.
Figure 7:
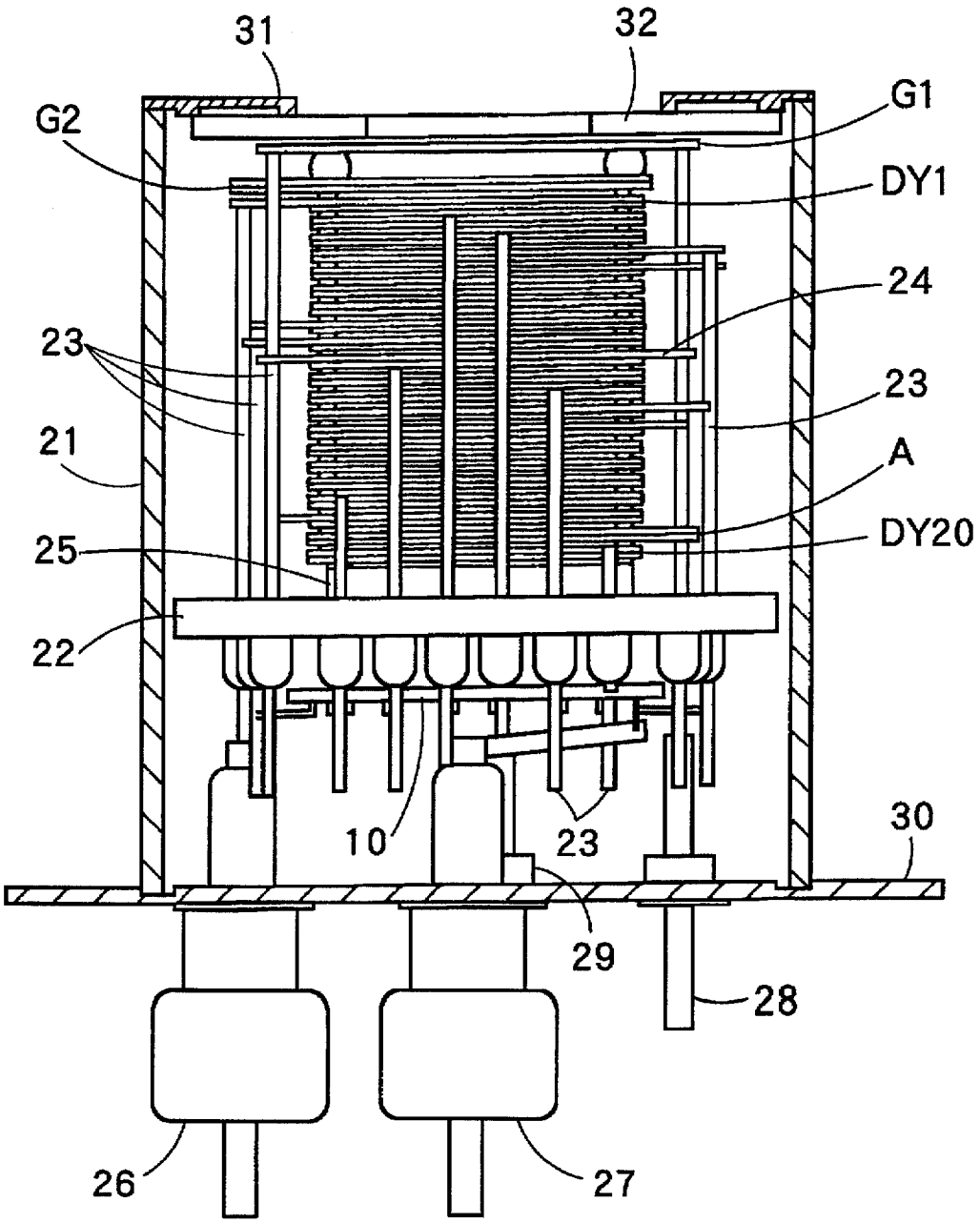
FIG. 7 is a cross-sectional view showing an electron multiplier according to the first embodiment, wherein the electron multiplier has a metal outer casing and uses the resistor of FIG. 3.
Figure 8:
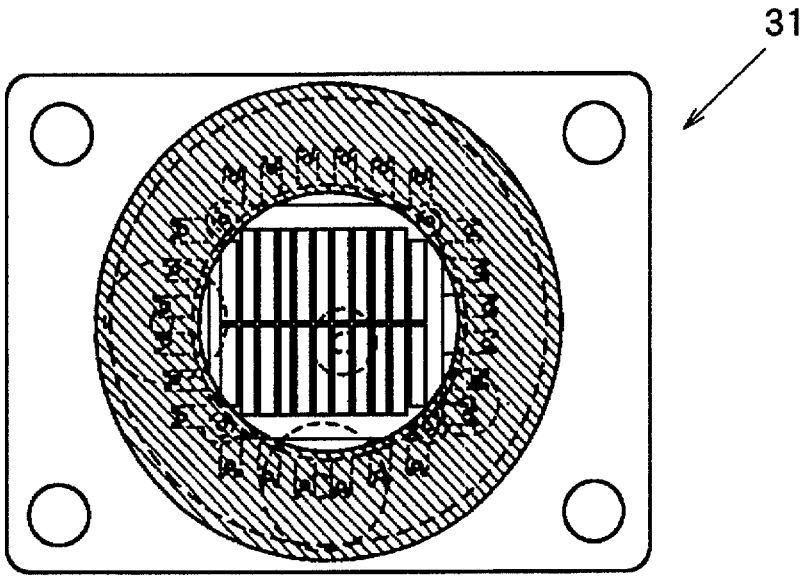
FIG. 8(A) is a planar view showing the top surface of the electron multiplier in FIG. 7.
FIG. 8(B) is a planar view showing the undersurface of the electron multiplier in FIG. 7.
Figure 8:
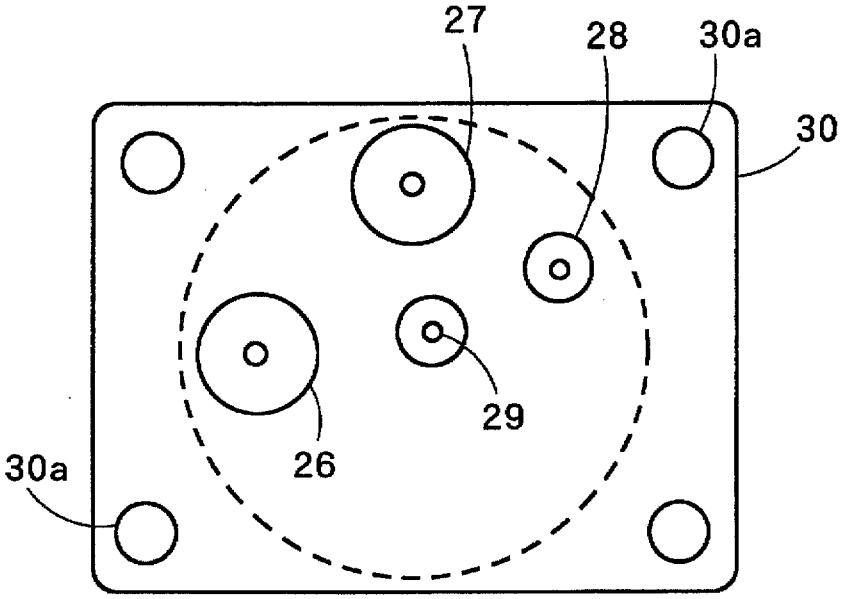

FIGS. 3 through 5 show a resistor assembly 10 according to a first embodiment of the present invention. The resistor assembly 10 is produced for use in an electron multiplier, which will be described later with reference to FIG. 7. The resistor assembly 10 constitutes a voltage divider circuit for dividing a source voltage and applying a predetermined voltage to each of dynodes Dy1 through Dy20 making up 20- stage stack of dynodes.

The resistor assembly 10 includes a two-sided 0.5 mm thick ceramic substrate 11, a top surface 11*a* of which is shown in FIG. 3 and an underside surface 11*b* of which is shown in FIG. 4. A plurality of insertion holes 12 are formed at a predetermined interval along the outer perimeter of the ceramic substrate 11. Resistor films R1 through R21 are formed on the surfaces of the ceramic substrate 11.

A plurality of metal conductors U are formed on the top surface 11*a* and the underside surface 11*b* of the ceramic substrate 11. One end of each metal conductor U is connected to one of the resistor films R1 through R21. As can be seen in FIGS. 3 and 4, each of the resistor films R1 through R21 is connected between the adjacent tips of metal conductors U. The other end of each metal conductor U extends to the inside of one of the insertion holes 12.

Figure 6:
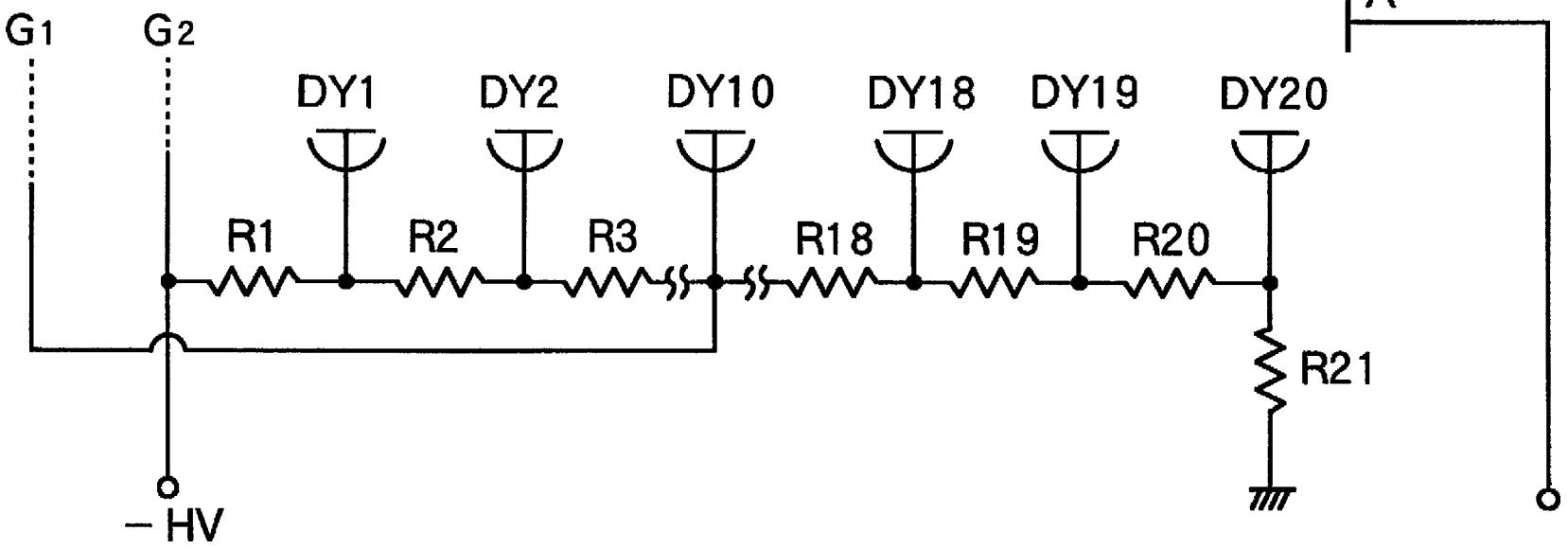
FIG. 6 is a circuit diagram showing a voltage divider circuit comprised of resistor films formed on the resistor.

As shown in FIG. 5, one end of each of a plurality of leads L is inserted into the insertion hole 12. The inserted end of each lead L is electrically connected to its corresponding metal conductor U by a conductive filling material (conductive paste) 13 that fills the insertion hole 12. Connecting the resistor films R1 through R21 formed on the top surface 11*a* and underside surface 11*b* to the corresponding metal conductor U produces the voltage divider circuit shown in FIG. 6.

The resistance of each of the resistor films R1 through R21 is set to a predetermined value by adjusting the width and length of each of the resistor films R1 through R21. In this embodiment, the resistor film R1 is set to 0.5 megohms, the resistor films R2 through R20 are set to 1.0 megohms, and the resistor film R1 is set to 0.5 megohms. The resistance of each resistor film is set so that output linearity of the electron multiplier and efficiency at which secondary electrons are collected at each dynode become optimal.

The leads L are connected only on the top surface 11*a* of the ceramic substrate 11. Therefore, welding operations performed when welding the leads to the dynodes and other components can be easily performed.

A cover glass 14 is attached to each of the top surface 11*a* and the underside surface 11*b* of the ceramic substrate 11 so as to cover and protect the resistor films R1 through R21 and the metal conductors U. As is best shown in FIG. 5, the cover glass 14 does not extend to cover the insertion holes 12. That is, the cover glass 14 covers the area that is inward from the insertion holes 12, thereby leaving the insertion holes 12 open. Another cover glass 15 formed from a glass material with a low melting point is attached to the top surface 11*a* to cover the area outward from the insertion holes 12 and the end of each lead L inserted in the insertion hole 12. The cover glass 15 protects the area around each insertion hole 12.

Next, an explanation of a method for manufacturing the resistor assembly 10 will be provided. First, through-holes which will become the insertion holes 12 are formed at predetermined positions on the ceramic substrate 11. Next, the material of the metal conductors U is screen printed on the top surface 11*a* and the underside surface 11*b* of the ceramic substrate 11 to form a wiring pattern with predetermined configuration. The ends of the wiring pattern are formed to reach the inner surface of corresponding insertion holes 12 as shown in FIG. 5. The pattern is dried and then baked to form-the metal conductors U.

The material of the resistor films R1 through R21 is then screen printed to form a resistor film pattern with predetermined configuration that connects adjacent end portions of the metal conductors U.

The paste-phase glass material, which is low in melting point, is formed, by screen printing, into a pattern that covers the metal conductors U and the resistor films R1 through R21 while leaving areas around the insertion holes 12 uncovered. Baking the paste glass material forms the cover glass 14.

At this stage, because the resistance values of the resistor films R1 through R21 may change caused by the formation of the cover glass, laser trimming for the resistor films is performed to adjust the resistance values thereof while monitoring the resistance between corresponding leads L. After the resistance values of the resistor films R1 through R21 have been corrected, a lead L is inserted into its corresponding insertion hole 12 formed into the ceramic substrate 11. At this time, the insertion tip of each 18 mm metal lead L is coated with an electrically conductive paste and then inserted into the corresponding insertion hole 12. After the space between the inserted lead L and the insertion hole 12 is again filled with conductive paste, the conductive paste 13 is baked. This process electrically connects the lead L to the metal conductors U via the conductive paste 13 and fixes each lead L in its insertion hole 12. As a result, the leads L will remain fixed in good contact with corresponding metal conductors U even during baking at 400° C.

Next, as shown in FIG. 3 by a reference numeral 15, a paste-phase glass material, which is low in melting point, is coated on the top surface 11*a* of the ceramic substrate 11 to cover the exposed portion at the end of each lead L. Afterward, the paste-phase glass material is baked to form the cover glass 15.

The resistor assembly 10 can be manufactured using other processes than those described above. For example, the pattern of the metal conductors U can be formed after the pattern for the resistor films R1 through R21. Also, the resistance value of the resistor films R1 through R21 can be adjusted at any time after formation of the cover glass 14.

Connection of the resistor assembly 10 to the dynodes can be easily implemented by electrically welding the leads L extending from the resistor assembly 10 to the dynodes. Although electron multipliers are sometimes used under extremely high temperatures of several hundred degrees or under high vacuum conditions of 10E(−5) Pa, the resistor assembly 10 thus manufactured can sufficiently withstand high vacuum and high temperatures. In addition, the resistor assembly 10 will release only slight amounts of gas.

Figure 9:
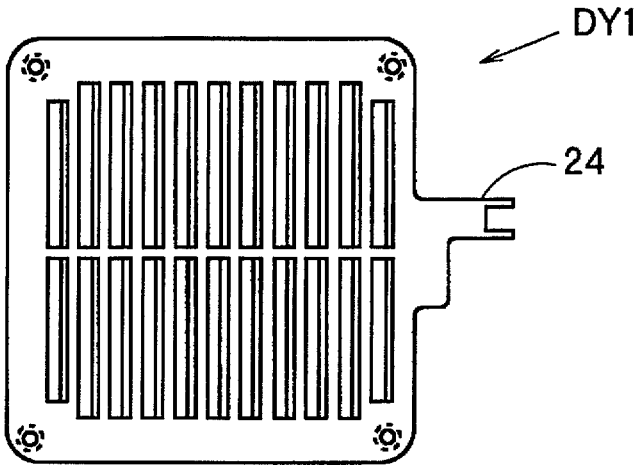
FIG. 9 is a planar view showing a first dynode in a dynode stack of the electron multiplier in FIG. 7.
Figure 10:
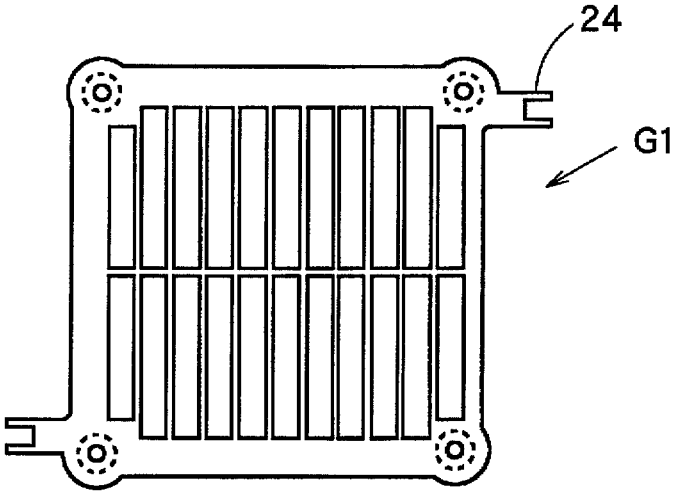
FIG. 10(A) is a planar view showing a mesh electrode of the electron multiplier in FIG. 7.
FIG. 10(B) is a planar view showing another mesh electrode of the electron multiplier in FIG. 7.
Figure 10:
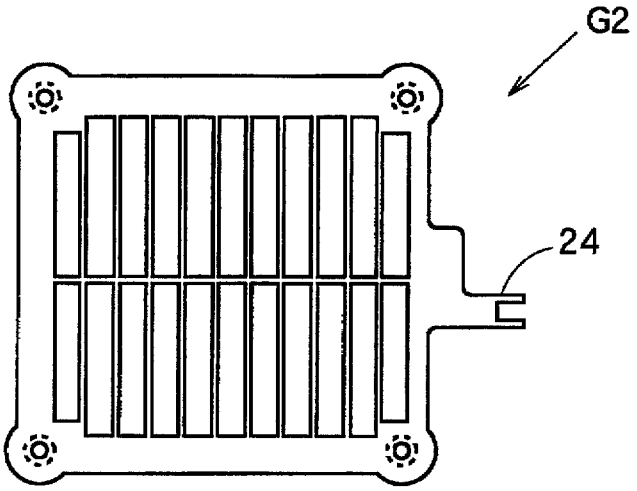

Next, an electron multiplier provided with the resistor assembly 10 will be described while referring to FIGS. 7, 8(A), 8(B), 9, 10(A) and 10(B). The electron multiplier includes 20-stage stacked dynodes DY1 through DY20 disposed interiorly of a cylindrical metal case 21. A configuration of each dynode is shown in FIG. 9. The electron multiplier further includes mesh electrodes G1 and G2 as shown in FIGS. 10(A) and 10(B), a collecting electrode (anode) A which is a mesh electrode in this embodiment, a ceramic plate 25, a stem 22, and the resistor assembly 10. The dynodes DY1 through DY20 catch and multiply primary ions. The collecting electrode A receives electrons emitted from the 19th stage dynode DY19 disposed immediately above the collecting electrode A and also electrons passed through the collecting electrode A and bounded from the final stage dynode DY20 disposed immediately below the collecting dynode DY20. The two mesh electrodes G1 and G2 are disposed upstream of the dynodes DY1 through DY20 and in alignment with each other in the direction in which energy ray falls incident on the first stage dynode DY1. The electric field developed by the mesh electrodes G1 and G2 brings the primary ions to impinge on an appropriate position of the first stage dynode DY1 so that secondary electrons are generated therefrom.

A protrusion fork 24 is provided to each of the dynodes DY1 through DY20 and to the mesh electrodes G1 and G2. A plurality of conductive stem pins 23 are disposed around the peripheries of dynodes DY1 through DY20 and mesh electrodes G1 and G2 so as to penetrate through the stem 22. Each protrusion fork 24 is connected to a stem pin 23 opposing thereto.

The ceramic plate 25 is sandwiched between the stem 22 and the final stage dynode DY20. The ceramic plate 25 serves to dispose the dynodes DY and the mesh electrodes G1 and G2 in parallel relation while preventing mutual contact therebetween.

The resistor assembly 10 is attached to the undersurface of the stem 22. The leads L extending from the resistor assembly 10 are welded to the relevant stem pins 23 penetrated through the stem 22. The voltages divided by the resistors in the resistor assembly 10 are applied to corresponding dynodes DY1 through DY20 via the corresponding stem pins 23.

Hermetic terminals 26 through 29 are connected to the anode A, the first stage dynode DY1, the second stage dynode DY2, and the final stage dynode DY20, respectively, of the stem pins 23. Hermetic terminals 26 and 27 are used for application of high voltage and are connected to the first stage dynode DY1 and the second stage dynode DY2, respectively. The hermetic terminals 28 and 29 are used for application of low voltage. The low-voltage hermetic terminal 29 is connected to the final stage dynode DY20 via a predetermined lead of the resistor assembly 10. The other low-voltage hermetic terminal 28 is connected to a stem pin 23 that extends from the anode A.

The hermetic terminals 26 through 29 are attached to a rectangular metal pedestal 30. A hole 30*a* is formed in the corner of the pedestal 30. The hole 30*a* is provided for attachment of the electron multiplier to an evacuating unit (not shown in the drawings) for developing a vacuum atmosphere. The above-described metal case 21 is welded to the pedestal 30. An insulator 32 made from a ceramic material is attached to the inner side of an upper surface 31 of the metal case 21. The insulator 32 is formed with a circular opening to provide a window at which energy ray is received.

Dynode stack greatly contribute to producing compact electron multipliers. However, when detecting incident ions using the dynode stack, not all ions will fall incident at the appropriate position of the first stage dynode DY1. Some ions will fall incident on the dynode frame and will not contribute to the electron multiplication. The mesh electrode G1 is provided immediately behind the window formed in the insulator 32 to adjust the ion incident position on the first stage dynode DY1. To this effect, a high positive potential is applied to the mesh electrode G1. The mesh electrode G1 is connected to the tenth stage dynode DY10, thus the same potential as applied to the mesh electrode G1 is also applied to the dynode DY10. With the provision of the mesh electrode G1 and by the application of the high positive potential thereto, the incident ions are directed to an appropriate position on the first stage dynode DY1, thereby improving the signal-to-noise ratio.

When positive ions are to be detected, the mesh electrode G1 is connected to the dynode DY10 to cause the mesh electrode G1 and the dynode DY10 to be the same potential. When negative ions or electrons are to be detected, the mesh electrode G1 is held to a potential lower than the first stage dynode DY1. The other mesh electrode G2 disposed below the mesh electrode G1 is provided for effectively guiding secondary electrons generated at the first stage dynode DY1 to the second stage dynode DY2.

Because the electron multiplier according to the first embodiment uses the resistor assembly 10 connected with leads L, it has a more compact configuration than conventional electron multipliers with individual resistor elements attached to each dynode. This also allows reducing the number of components and the amount of manufacture time required for providing contact between electrodes.

Figure 11:
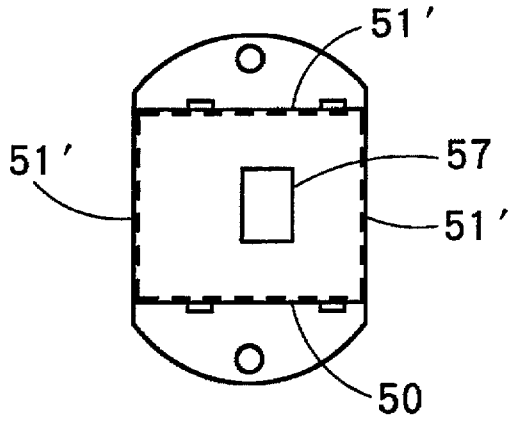
FIG. 11(A) is a planar view showing the upper surface of an electron multiplier according to a second embodiment of the present invention.
FIG. 11(B) is a side view showing the electron multiplier of FIG. 11(A)
FIG. 11(C) is a planar view showing the under surface of the electron multiplier of FIG. 11(A)
Figure 11:
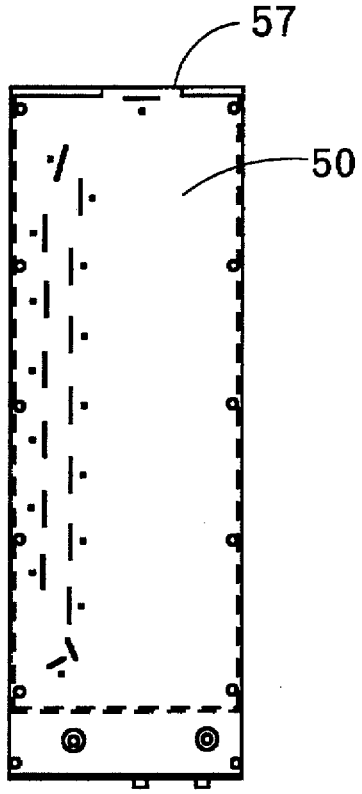
Figure 11:
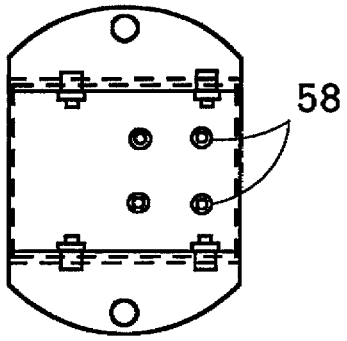

An electron multiplier according to a second embodiment of the present invention will next be described while referring to FIGS. 11(A) through 11(C). The electron multiplier according to a second embodiment includes line-focus type dynodes, which multiply and output energy rays incident on a window 57. A four-walled housing is provided for containing the dynodes. A resistor assembly 50, which is similar to the resistor assembly 10 of the first embodiment, forms one wall and ceramic substrates 51' form the other three walls. Hermetic terminals 58 are protrude from the bottom portion of the electron multiplier.

Figure 12:
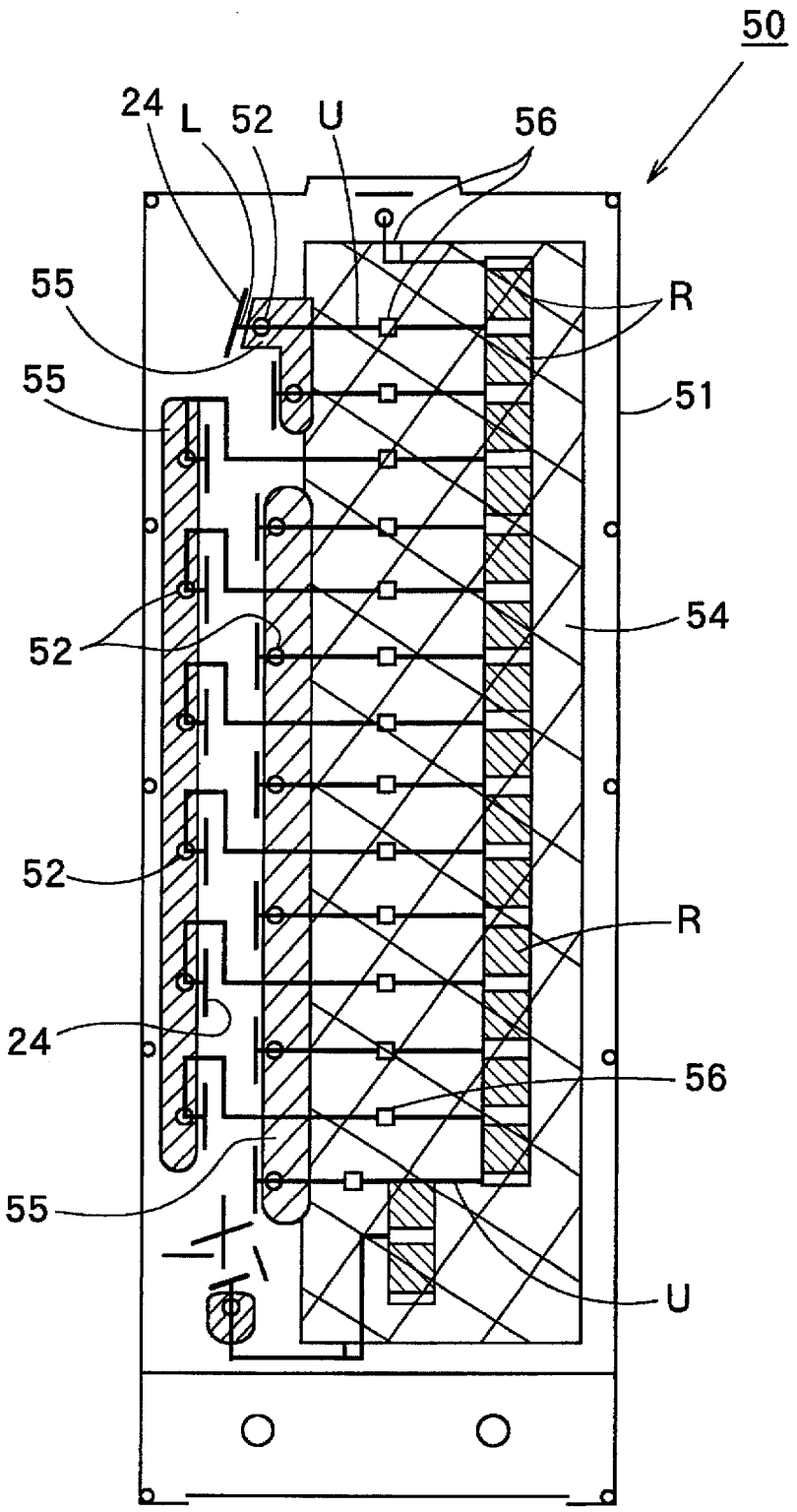
FIG. 12 is a planar view showing a resistor used in the electron multiplier according to the second embodiment.

FIG. 12 shows details of the resistor assembly 50 removed from the electron multiplier. The resistor assembly 50 is manufactured in the same manner as described in the first embodiment for the resistor assembly 10. That is, resistor films R are formed on the surface of the ceramic substrate 51 of the resistor assembly 50. A plurality of metallic conductors U are formed so that one end of each is disposed on one side of a corresponding resistor film R. That is, resistor films R are sandwiched by and connected to ends of the conductors U. Additionally, each metal conductor U is formed so that its other end extends to one of a plurality of insertion holes 52 where it is electrically connected, using conductive paste (not shown), to an end of a corresponding lead L inserted in the insertion hole 52. The other end of the lead L is connected, using electric welding, to one of a plurality of protrusion forks 24. Each protrusion fork protrudes from a component such as a mesh electrode, each dynode, or an anode and through a corresponding one of a plurality of slits formed in both the resistor assembly 50 and also in the opposing ceramic substrate 51'. Because protrusion forks 24 of each component are inserted into its opposing slit, the corresponding components, such as the dynodes are supported on both sides by the resistor assembly 50 on one side and a ceramic substrate 51' on the other.

Cover glass 54, which is a glass with a low melting point, is formed to cover the resistor films R and the metal conductors U and to maintain them in a desired configuration. A cover glass 55, which is the same glass with a low melting point, is formed to regions that include insertion holes 52.

An electrode portion 56 is formed on the metal conductors U and is used for measuring resistance value of the resistance films R.

Figure 13:
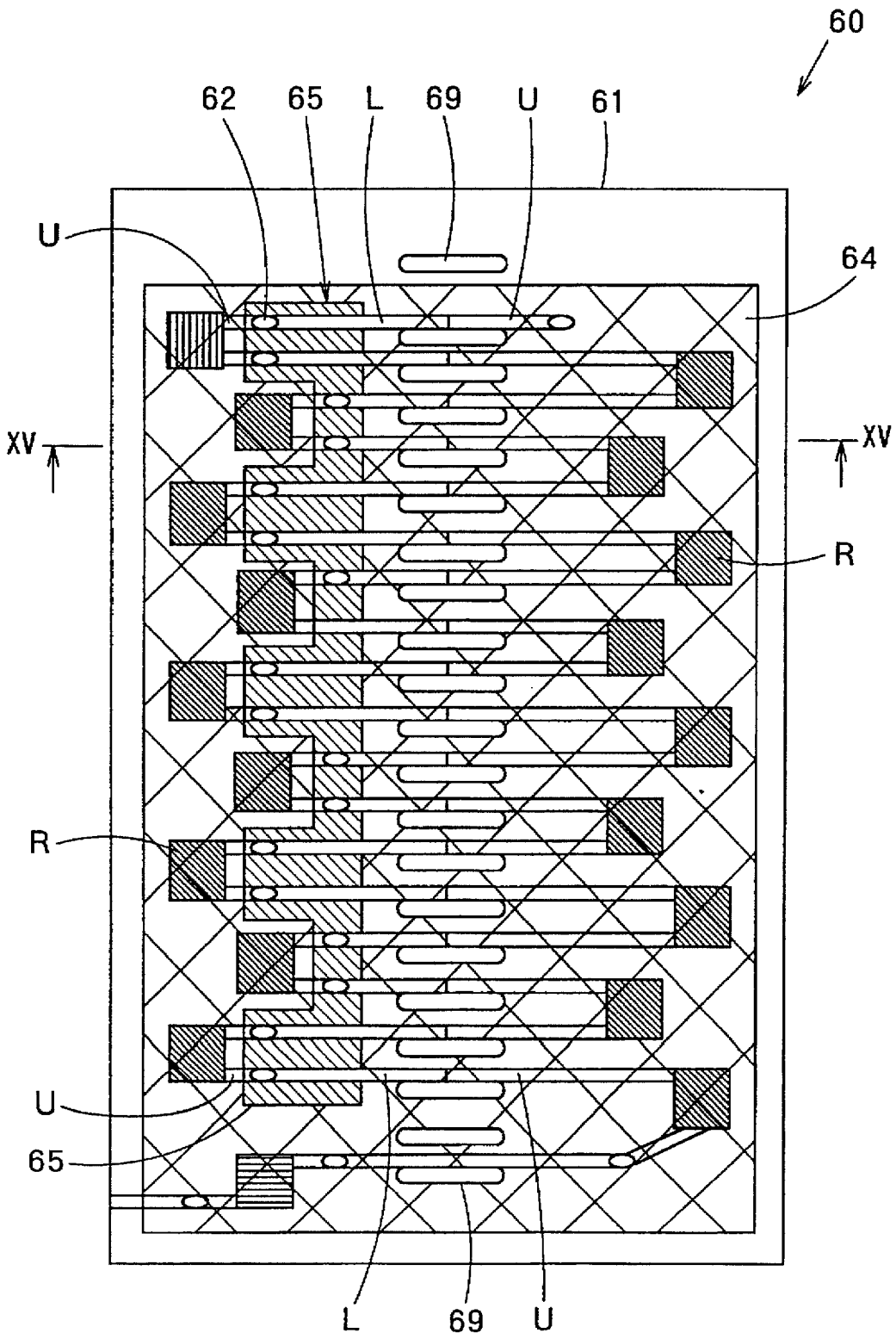
FIG. 13 is a planar view showing a resistor according to a third embodiment of the present invention.
Figure 15:
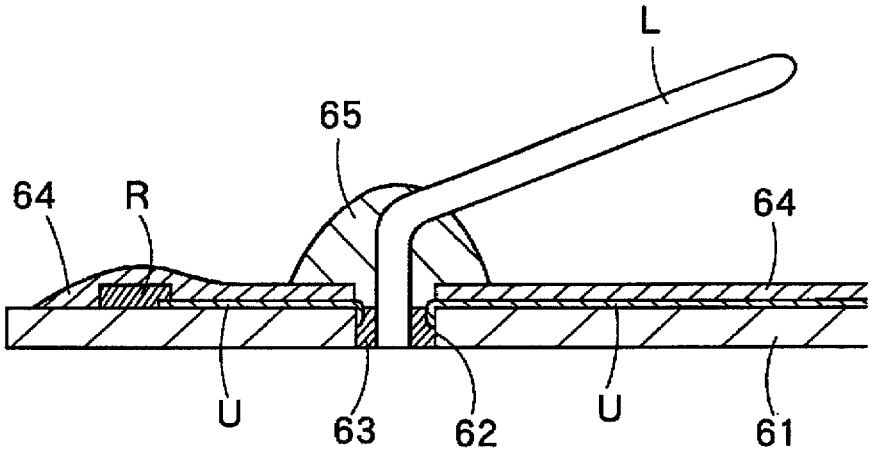
FIG. 15 is a cross-sectional view taken along line XV—XV of FIG. 13.

FIG. 13 shows a resistor assembly 60 according to a third embodiment of the present invention. With the resistor assembly 60, resistor films R and metal conductors U are formed on a ceramic substrate 61, and then cover glasses 64 and 65 are coated to cover the resistor films R and metal conductors U. In this embodiment, the resistor films R are arranged in staggered fashion along both sides of the ceramic substrate 61, aligned substantially in the lengthwise direction. The resistor films R positioned on the left-hand and right-hand sides are formed by connecting the metal conductors U one after the other. Insertion holes 62 are formed near those resistor films R arranged on the left-hand side. As shown in FIG. 15, one end of each lead L is fixed in place in a corresponding insertion hole 62 using conductive paste 63.

Slits 69 are formed near the center of the ceramic substrate 61 aligned in the lengthwise direction. The dynodes and other components are supported in place by inserting their protrusion forks 24 into corresponding slits 69.

When the dynodes and the like are supported in this way, the protrusion forks 24 will protrude from corresponding slits 69 in the direction perpendicular to the surface of the sheet on which FIG. 13 is drawn. The tip of each lead L is connected, by electric welding, to a corresponding protrusion fork 24.

Figure 14:
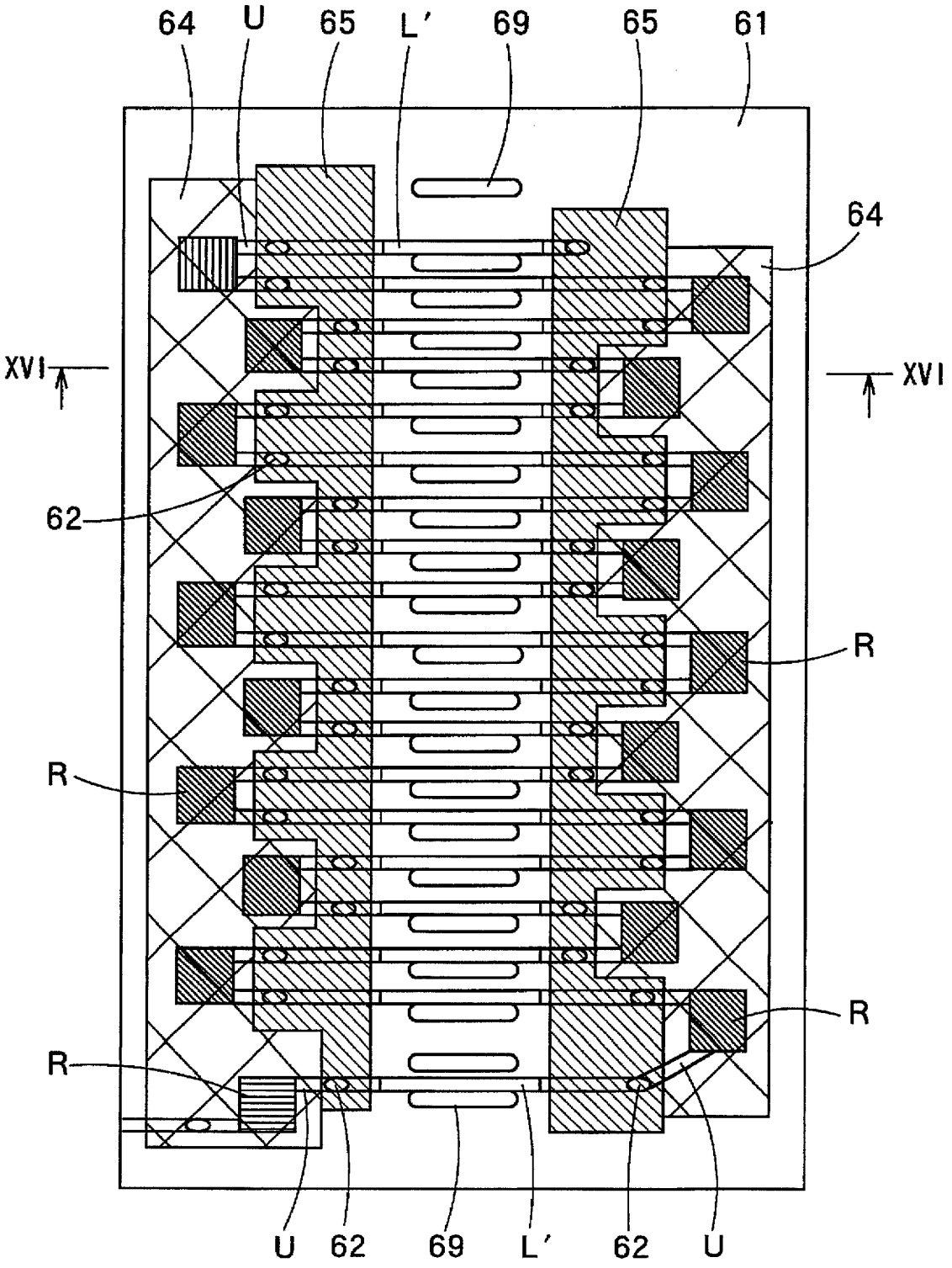
FIG. 14 is a planar view showing another example of the electron multiplier shown in FIG. 13.
Figure 16:
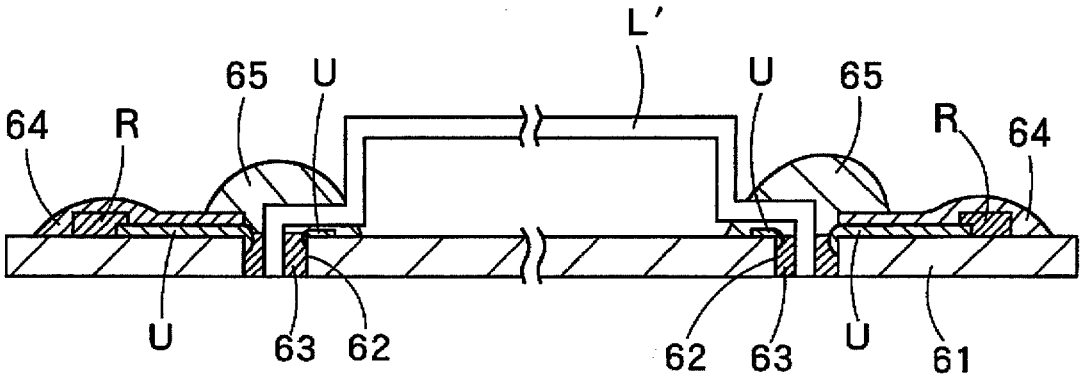
FIG. 16 is a cross-sectional view taken along line XVI—XVI of FIG. 14.

As shown in FIGS. 14 and 16, the resistor films R positioned to the left and right can alternatively be connected by bent lead pins L'. In this case, the insertion holes are formed near the resistor films R juxtaposed on both lefthand and righthand sides. Both ends of each lead pin L' are inserted into corresponding insertion holes 62. Therefore, it becomes unnecessary to provide the metal conductors U for connecting sides of the resistors films. A cover glass 64 is applied to cover the resistor films R and the metal conductors U extending from the resistor films R to the insertion holes 62. Another cover glass 65 is provided for covering the area where the lead pins L' are inserted.

The lead pins L' are connected to protrusion forks 24 of the components in the same manner as described while referring to FIGS. 13 and 15. That is, protrusion forks 24, which protrude from corresponding slits 69, are connected to lead pins L' using electric welding, at the position where the protrusion forks 24 protrude.

The substrate can be made from insulating materials other than ceramic. For example the substrate can be made from steatite, glass, or polyimide resin.

Two types of low-melting-point glass were used for cover glass. However, the same low-melting-point glass can be used to cover all areas to be protected. For example a glass paste, such as $PbO—ZnO—SiO_2$ or $ZnO—B_2O_3—SiO_2$, or an amorphous glass, such as $PbO—B_2O_3—SiO_2$, can be used as the glass with a low melting point.

Leads L and the lead pins L' were described above as members connected to the protrusion forks 24 of the dynodes and other components. However, differently shaped conductors such as wires plates, or ribbons, can also be used.

Because the resistor assembly according to the present invention is a flat shape plate by forming the conducting pattern, the resistor films, and the like on the insulating substrate, space required to attach the resistor assembly is reduced to a minimum. The conductive materials for making connections is also formed on the insulating substrate together with the resistor films, so that the resistor assembly can easily be attached to electron multipliers and other devices. Attachment operations can be effectively performed. Further, manufacturing costs can be reduced because fewer parts are required.

Moreover, the resistor assembly of the present invention can be disposed in a very small space of the electron multiplier, therefore, the electron multiplier can be made in a small and compact shape.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. An electron multiplier comprising:

a plurality of dynodes including a first stage dynode for receiving radiant energy and a final-stage dynode, said plurality of dynodes being arranged in a predetermined configuration to successively multiply radiant energy by emission of secondary electrons;

a collection electrode disposed adjacent to the final stage dynode to receive the secondary electrons emitted from the final stage dynode;

a substrate for supporting said plurality of dynodes; and a resistor assembly for dividing a predetermined d.c. voltage and applying a divided voltage across each of said plurality of dynodes, said resistor assembly including:

an insulation substrate formed with a plurality of holes, said insulation substrate having a first surface and a second surface opposite the first surface;

a plurality of thin film resistors formed on the first surface of said insulation substrate, each of said plurality of thin film resistors having a first terminal and a second terminal;

a plurality of thin film conductors formed on the first surface of said insulation substrate, each of said plurality of thin film conductors having a first end and a second end wherein the first terminal and the second terminal of each of said plurality of thin film resistors are connected respectively to first ends of two thin film conductors selected from said plurality of thin film conductors and wherein each of the second ends of the two thin film conductors extends to selected one of the holes formed in said insulation substrate;

a plurality of leads, each having a first end and a second end wherein the first end of each of said plurality of leads is inserted into one of the holes formed in said insulation substrate and electrically connected to a corresponding thin film conductor, and wherein a predetermined resistance value is given between selected two second ends of said plurality of leads; and an insulating seal covering at least an area where each of said plurality of leads is connected to the corresponding thin film conductor and an area where each of said plurality of thin film resistors are formed, wherein the second end of each of said plurality of thin film conductors is electrically connected to a corresponding dynode of said plurality of dynodes.

2. A resistor assembly as claimed in claim 1, wherein said insulating seal comprises:

a first seal covering said plurality of thin film conductors and said plurality of thin film resistors; and a second seal covering the area where each of said plurality of leads is connected to the corresponding thin film conductor.

3. A resistor assembly as claimed in claim 2, wherein said insulating seal is formed from a glass material.

4. A resistor assembly as claimed in claim 1, wherein said plurality of thin film resistors, said plurality of thin film conductors, and said insulating seal are also provided to the second surface of said insulation substrate, and wherein the thin film conductors formed on the first side of said insulation substrate are connected to the thin film conductors formed on the second side of said insulation substrate through the holes formed in said insulation substrate.

5. A resistor assembly as claimed in claim 1, wherein each of said plurality of thin film resistors having a width and a length, a resistance value of the thin film resistor being determined by its width and length.

6. A resistor assembly as claimed in claim 5, wherein said plurality of thin film resistors are connected in series by said plurality of thin film conductors to provide a serially connected resistor circuit, said resistor circuit serving as a voltage division circuit when a predetermined d.c. voltage is applied between one lead selected from said plurality of leads and another lead also selected therefrom.

7. A resistor assembly as claimed in claim 1, wherein the seconds ends of said plurality of leads extend to a space at a side of the first surface of said insulation substrate.

8. An electron multiplier as claimed in claim 1, further comprising:

a window on which the radiant energy falls incident; and two mesh electrodes arranged between said window and said first stage dynode, for guiding the radiant energy onto a relevant position on said first stage dynode.

9. An electron multiplier as claimed in claim 8, further comprising:

a plurality of connection pins provided corresponding to said plurality of dynodes and disposed around said plurality of dynodes, each of said plurality of connection pins extending in a direction in which said plurality of dynodes are arranged in stacked fashion, each of said plurality of connection pins having a first end and a second end, the first end of each of said plurality of connection pins being connected to a corresponding dynode, the second end of each of said plurality of connection pins passing through and protruding from the second surface of said insulation substrate, and wherein said resistor assembly is disposed on the second surface of said insulation substrate and the second ends of said plurality of leads are connected respectively to the second ends of said plurality of connection pins.

10. An electron multiplier as claimed in claim 9, further comprising a casing for enclosing said plurality of dynodes, said collection electrode, said resistor assembly, said two mesh electrodes, and said plurality of connection pins, said casing being made from a metal.

11. An electron multiplier as claimed in claim 10, further comprising a plurality of hermetic terminals connected to selected ones of said plurality of dynodes and to said collection electrode for applying respective voltages thereto.

12. The electron multiplier according to claim 1, wherein said plurality of thin film resistors are formed by screen printing.

* * * * *